US006425794B1

(12) United States Patent
Levy et al.

(10) Patent No.: US 6,425,794 B1
(45) Date of Patent: Jul. 30, 2002

(54) IMPACT-ABSORBING WING CONNECTION SYSTEM FOR MODEL AIRCRAFT

(76) Inventors: Alejandro Velasco Levy; Ildiko Palyka, both of P.O. Box 109, Upton, NY (US) 11973

( * ) Notice: Subject to any disclaimer, the term of this patent is extended or adjusted under 35 U.S.C. 154(b) by 0 days.

(21) Appl. No.: 09/413,201

(22) Filed: Oct. 5, 1999

(51) Int. Cl.[7] ..... A63H 27/00; A63H 27/04
(52) U.S. Cl. ..... 446/34; 446/61
(58) Field of Search ..... 446/34, 55, 56, 446/30, 31, 61, 22, 66, 67, 68, 36

(56) References Cited

U.S. PATENT DOCUMENTS

| | | | | |
|---|---|---|---|---|
| 3,935,664 A | | 2/1976 | Neuhierl | |
| 4,233,773 A | * | 11/1980 | Jones | 446/34 |
| 4,272,912 A | * | 6/1981 | Lapierre | 446/34 |
| 4,494,940 A | | 1/1985 | Gretz | |
| 4,698,041 A | * | 10/1987 | Dasa | 446/61 |
| 4,714,444 A | * | 12/1987 | Rendel | 446/61 |
| 5,853,312 A | * | 12/1998 | Li | 446/61 |
| 5,947,785 A | * | 9/1999 | Bausch | 446/36 |

* cited by examiner

*Primary Examiner*—Derris H. Banks
*Assistant Examiner*—Alif Abdelwahed

(57) ABSTRACT

An impact absorbing wing connection system for model airplanes and other flying toys of the type having a fuselage (10) and separate wings (14) that are to be inserted into wing slots (12) in the fuselage for flight. The friction between the touching surfaces of the wings and the wing slots is reduced by a low friction coating (18) over the wing roots (16) or by other friction reducing means so that a tight fit is preserved. The wings are oriented into their proper flying positions by their exact fit with the fuselage, and they are kept in these positions during normal flight by a set of non-elastic break-away links (26) which are attached to the wings and to the fuselage through a corresponding set of wing connecting members (20) and fuselage connecting members (24), respectively. In case of a crash, the inertia forces of the wings are conveyed to the break-away links by the connecting members. The break-away links are calibrated so that they are strong enough to prevent any lateral movement of the wings under reasonable flying conditions but they break open under the forces of the crash, releasing the wings. The detachment of the wings absorbs most of the impact forces, protecting the aircraft from breaking.

20 Claims, 6 Drawing Sheets

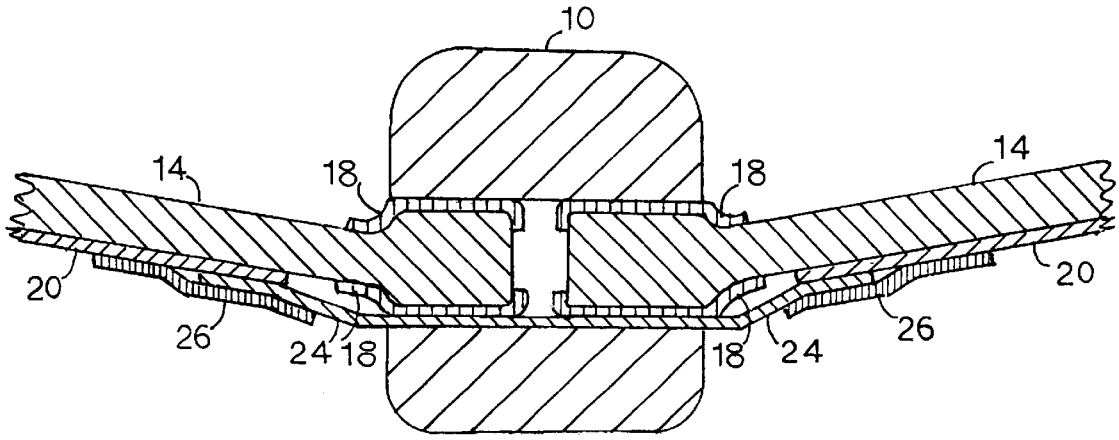
FIG.8
FIG.9A
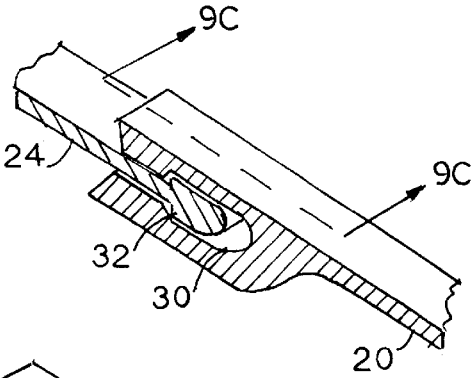
FIG.9B
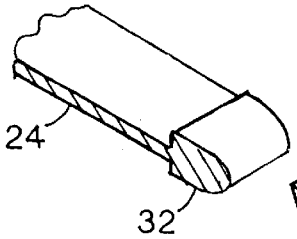
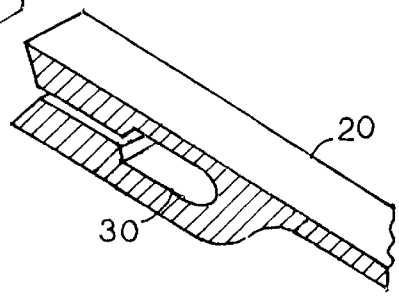
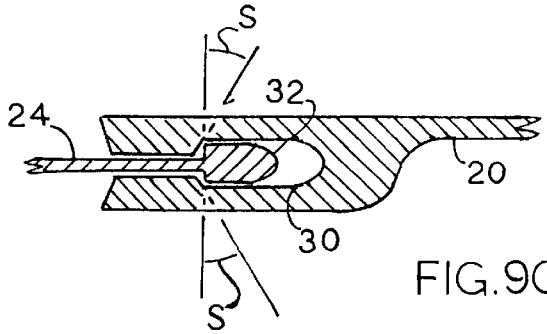
FIG.9C

IMPACT-ABSORBING WING CONNECTION SYSTEM FOR MODEL AIRCRAFT

CROSS-REFERENCE TO RELATED APPLICATIONS

This invention can be used on model aircraft in combination with the tow-release mechanism described in our co-pending U.S. patent application Ser. No. 09/413,199, filed Oct. 5, 1999, and/or with the automatic pilot system described in our co-pending U.S. patent application Ser. No. 09/413,200, filed Oct. 5, 1999. The combination of these three systems produces a model glider that has no mechanically moving parts, yet it is able to take-off, fly, and land in a user-selected pattern, and it is sturdy and durable.

BACKGROUND OF THE INVENTION

This invention relates to model airplanes and other flying toys which have a fuselage and separable inserted wings, specifically to a connection system which holds the wings securely in a slot in the fuselage during normal flight but releases them in case of a crash in order to absorb the force of the impact.

Many model airplanes and other flying toys have non-flexible wings which are attached to the fuselage during operation but which are detachable for easier packaging and transportation as shown in U.S. Pat. Nos. 4,233,773, 4,272,912, and 4,714,444. In several models, the removable wings are inserted into a slot or recess in the fuselage, as seen in U.S. Pat. Nos. 3,935,664, 4,494,940, 4,698,041 and 5,853,312. Flying toys with flexible wings which can be easily folded for transportation, such as U.S. Pat. No. 5,947,785, do not typically have removable wings.

For a stable flight performance, it is important that the wings stay in place during flight without any significant ;movement, so most models described in the prior art utilize some kind of wing securing means. It case of a crash landing, however, it is beneficial if the wings are allowed some movement in order to lessen the momentum the fuselage must absorb. An ideal wing assembly system would hold the wings securely in place during take-off, flight and normal landing while it would release them in case of a crash.

The simplest wing assembly found in the prior art, especially in the case of models built of rigid plastic foam, is to fit the wings very tightly into a slot in the fuselage and, thus, rely on friction to keep them in place. Theoretically, this frictional fit should hold the wings securely attached during flight but it should release them in the event of a crash when the impact forces are greater than the friction forces. This would protect the plane from breaking. In reality, however, the frictional fit works only for a few separations and re-insertions of the wings. This is because the material on the attachment surfaces wears down, resulting in a loose fit. Therefore, the model becomes useless after just a few detachings of the wings, whether due to transportation or crash-landing, since its wings can now shift out of their normal positions during flight. Furthermore, before the tight fit wears away, it is very cumbersome to insert such wings into their proper positions.

To provide more secure attachment for the wings, most models described in the prior art rely upon an additional component to hold the assembly together. In U.S. Pat. No. 5,853,312, a firm adapter is used to secure the wings to the fuselage. The adapter is supposed to keep the wings in place even in the case of a crash landing. To address the issue of impact protection, the nose of the airplane has a specially designed buffer that absorbs some of the impact forces. The major disadvantage of this is that while the nose buffer might work on the specific airplane shown, it cannot be easily adopted to other designs. Another disadvantage is that it only protects the airplane in a straight ahead crash when the nose of the fuselage hits an obstacle. In practice, it is more frequent to have a crash where the wing hits an obstacle. In this case, the nose buffer would provide no protection.

Other models described in the prior art rely on an elastic member to secure the wings to the fuselage. In most cases, the elastic member is supposed to keep the wings in place in a crash but allow them some movement to relieve the stress on the assembly. The major disadvantage of this type of wing connection is that in case of a fast take-off or strong winds, the wings might shift out of their proper positions because of the elasticity of the connection. Also, most elastic materials tend to lose their strength with time, so the movement of the wings can become more pronounced with extended use.

One of the inventions that relies on this type of elastic connection is described in U.S. Pat. No. 4,272,912. Here, the use of flexible connecting rods is proposed to keep the wing permanently attached to the fuselage, while providing some stress protection to the wings in case of a crash. The main disadvantage of this system is that since the connecting members are elastic, they allow some movement to the wings in case of a fast take-off or strong winds, resulting in decrease flight performance. Another disadvantage of this approach is that it is applicable only to an airplance that has struts external to the fuselage for holding the wing to the fuselage. Therefore, it cannot be used in rigid foam planes where the wings are inserted into a fuselage cavity, which is the type of design the present invention is focused upon.

U.S. Pat. No. 4,494,940 to Gretz (1985) describes an elastic clip that fits across the fuselage and into holes in the wings. This approach, however, also has several unwelcome properties: (a) By design, the connecting clip allows the wings some movement with respect to the fuselage. Initially, the wing-fuselage connection is reinforced by a tight frictional fit, and the wings stay in place under normal conditions. When the frictional fit wears away, the wings can shift out of their correct position during a normal flight, even with the clip in place. (b) Also by design, each wing needs to have hole(s) to receive the connecting clip. This weakens the wing at its root, which is precisely the part of the wing that carries the greatest structural load, and is usually reinforced to sustain it. (c) To make the plastic clip fit flush with the adjacent surfaces, a recess might be formed across the top of the fuselage. This, unfortunately, weakens the fuselage. Because of its reduced cross-section, this is the part that is most likely to break in a hard landing, rendering the aircraft useless. (d) The inertia forces of a wing that comes to a sudden stop in a crash are transmitted to the connecting clip by the walls of the receiving hole. If the clip is made of a harder material than the wings are (as in the case of plastic foam airplanes), the holes in the wings become enlarged and distorted after a few crashes. Consequently, the wings are no longer held in their correct positions with respect to the fuselage.

Another example of the use of an elastic, member, in this case a spring, is given in U.S. Pat. No. 4,233,773. The wing has two pins or dowels located in the middle of the leading and trailing edges of the wing that are inserted into holes located in the middle of the fuselage. To join the wing to the fuselage, the user inserts the leading edge dowel into its fuselage hole and by sliding the wing forward he is able to insert the rear dowel into its fuselage hole. This forward sliding motion compresses a spring mounted inside the wing. Since the force of the compressed spring pushes the wing rearward it prevents the rear dowel from coming out of its hole, thus holding the wing securely to the fuselage. If the nose of the fuselage hits an obstacle, the inertia of the wing will be strong enough to overcome the backward force of the spring, the wing will then slide forward allowing the rear dowel to slide out of its fuselage hole. Thus the wing is separated from the fuselage avoiding damage in case of a crash. The main disadvantage of this system is that it only detaches the wing in a straight ahead crash when the nose of the fuselage hits an obstacle. In practice it is more frequent to have a crash where the wings hits an obstacle. When this happens the wing will be damaged since the wing dowels are inside the fuselage holes and this situation does not allow the wings to move laterally or rotate during a wing tip crash; therefore, the wing will not separate from the fuselage. Another disadvantage of this system is that it is not applicable to rigid foam airplanes that tightly insert the wings into a fuselage receptacle, since the wings cannot slide forward or backward inside such a tight fuselage receptacle.

There are designs in the prior art where the elastic member, typically a rubber band, is designed to keep the wings in place during flight, but it allows them to break away in case of a crash. An example of this approach is shown in U.S. Pat. No. 4,714,444. It is likely that such a rubber band allows some movement to the wings in case of a fast takeoff or strong winds, resulting in decreased flight performance. If this is to be avoided by frictional fit between the wing and the fuselage, material wear-down becomes a problem.

The above problems result from the use of frictional fit and/or an elastic connecting member for holding the wings in their flying positions. Consequently, these problems can be solved by eliminating (or significantly reducing) the frictional fit, and providing non-elastic means to secure the wings, which would break away in case of a crash.

SUMMARY OF THE INVENTION

The present invention provides an impact-absorbing wing connection system for a model aircraft that has wings which are inserted into the fuselage. The present invention addresses three major shortcomings in the prior art: 1.) when an elastic member is used to secure the wings to the fuselage, the wings can exhibit some movement during flight because of the elasticity of the connecting member; 2.)when the wings are kept in the fuselage even in case of a crash, the impact forces can significantly damage the aircraft; and 3.)when the wings are repeatedly inserted into and removed from the wing slot, the friction causes the surfaces to wear away and allow significant movement of the wings during flight. This latest issue is especially important for rigid foam airplanes. The novel concepts of the present invention are: 1.)it uses connecting links that are non-elastic to secure the wings to the fuselage to prevent any movement during flight; 2.)the non-elastic links are designed to break in case of a crash to release the wings; and 3.)it applies a low friction protective coating on the inserted portion of the wings to facilitate the separation of the wings and to reduce the wear between the contact surfaces.

In accordance with the present invention, a durable, impact-absorbing wing connection system for model aircraft and other flying toys of the type having disjoined wings that fit into lateral slots in the fuselage comprises means for reducing the friction while preserving the tight fit between the wings and the fuselage, a set of non-elastic break-away links to hold the wings securely in the fuselage during flight, and a corresponding set of connecting members on the fuselage and the wings, respectively, to which the break-away links are attached. The wings are placed into their proper flying positions easily, because of their low friction fit with the fuselage, and they are kept in these positions during normal flight by their tight fit and the non-elastic break-away links. In case of a crash, the inertia forces of the wings are conveyed to the break-away links by the connecting members. The strength of the break-away links is calibrated so that they snap upon a crash, releasing the wings. Because their reduced friction, the wings slide of the wing slots easily, absorbing the impact forces, and protecting the wings from breaking.

Accordingly, several objects and advantages of the present invention are:

(a) to provide a wing connection system, which uses no elastic members, so that the wings are kept firmly in place during high-speed take-off, flight, and landing;

(b) to provide a wing connection system, which releases the wings in case of a crash in order to absorb the impact forces, and does so without damaging any structural part but the designated break-away link;

(c) to provide a wing connection system, in which the wings can easily slide in and out of the fuselage without producing premature wear on the connecting surfaces, so that the initial tight fit is preserved even after repeated assemblies and disassemblies;

(d) to provide a wing connection system, which does not weaken the structural integrity of either the wings or the fuselage;

(e) to provide a wing connection system, which makes the assembly and disassembly of the wings simple and fast;

(f) to provide a wing connection system, in which the break-away link can be easily and inexpensively replaced; and (g) to provide a wing connection system, which can be used on models made of soft material, such as molded plastic foam.

Further objects and advantages are to provide a wing connection system, which is inexpensive to manufacture, and which, at least in some embodiments, can be installed on many existing model airplanes by simple adhesive means. Still further objects and advantages. will become apparent from a consideration of the ensuing description and drawings.

BRIEF DESCRIPTION OF THE DRAWINGS

In the drawings, closely related figures have the same number but different alphabetic suffixes.

FIG. 8 is a cross-section of the assembled wing and fuselage along line 8—8 of FIG. 3.

FIG. 9A is a perspective view of an alternative embodiment of the break-away link when wing is attached.

FIG. 9B is the same as FIG. 9A, when the wing is detached.

FIG. 9C is a cross section of the alternative break-away link along line 9—9 of FIG. 9A.

REFERENCE NUMERALS USED IN THE DRAWINGS

| | |
|---|---|
| 10 | fuselage |
| 12 | wing slot |
| 14 | wing |
| 16 | wing root |
| 18 | low-friction coating |
| 20 | wing connecting member |
| 22 | reinforcing member |
| 24 | fuselage connecting member |
| 26 | non-elastic break-away link |
| 28 | edge of wing root |
| 30 | break-away receptacle |
| 32 | break-away Clasp |

DETAILED DESCRIPTION OF THE INVENTION

FIGS. 1 to 8 illustrate the preferred embodiment of the invention. It is demonstrated on a model glider typical of the kind made of rigid plastic foam, such as Styrofoam, which has one continuous slot in the fuselage for the left and right wings. Since foam airplanes generally have friction-fitted wings, and their wings and fuselages tend to break easily upon high impact, this type of model aircraft benefits most from use of the proposed impact-absorbing wing connection system. Every component of the preferred embodiment is designed so that they can be easily installed on such a glider without requiring any modifications of its original structural design.

Figure 1:
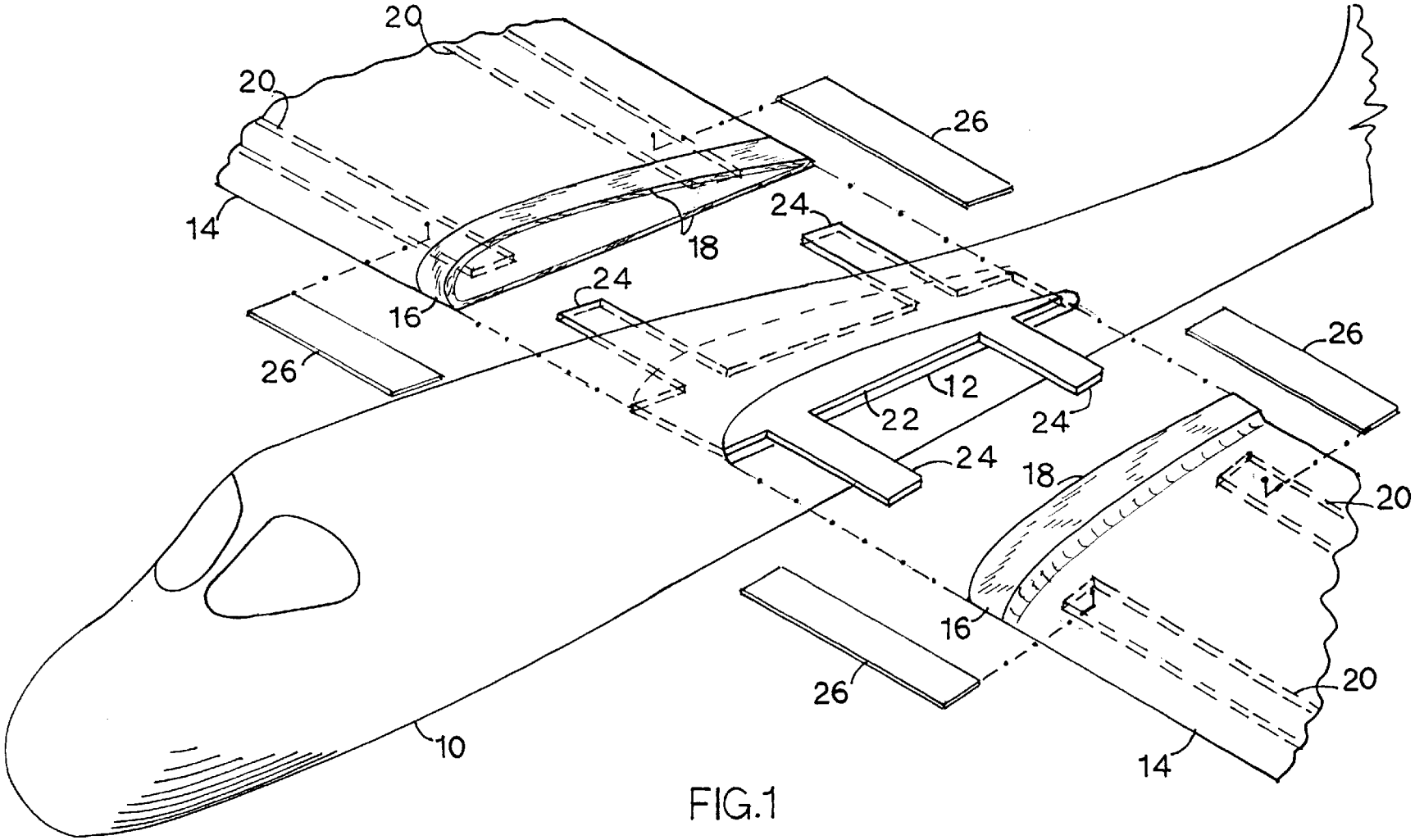
FIG. 1 is a top perspective view of a portion of a model glider, showing the positions of the wing connection system's components.
Figure 2:
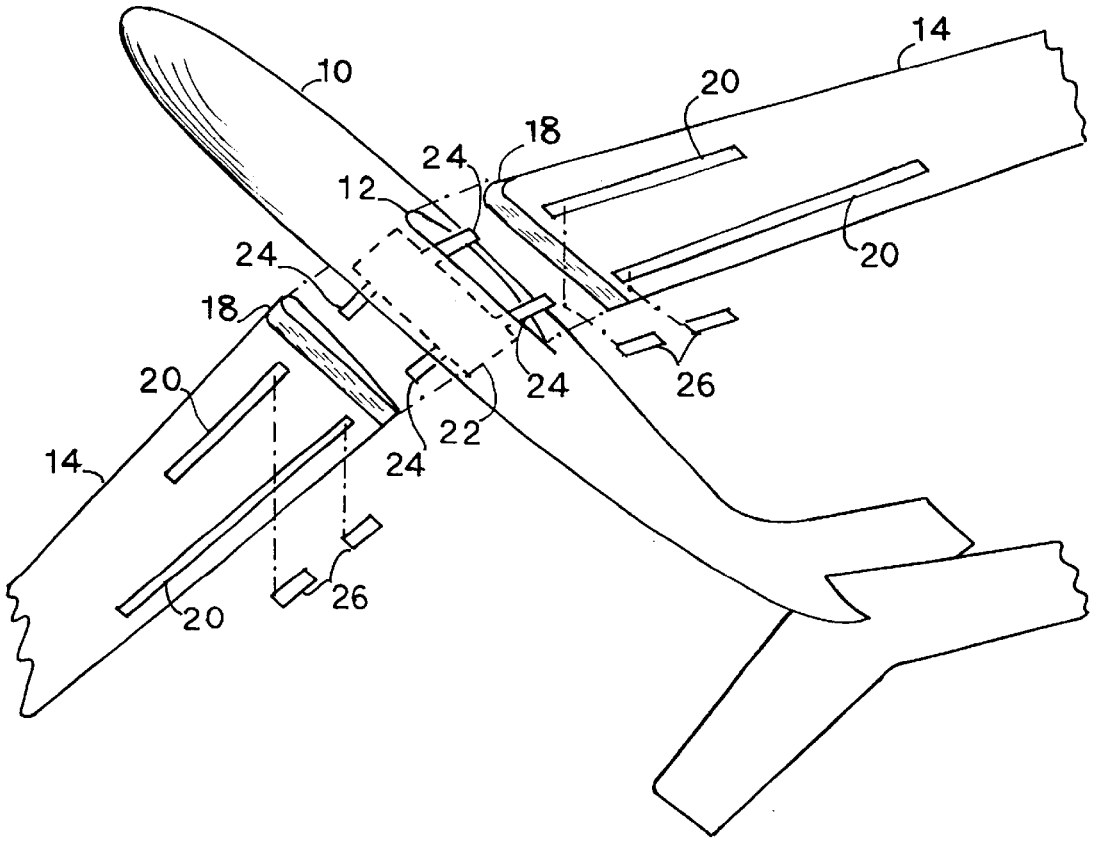
FIG. 2 is a bottom perspective view of a portion of a model glider, showing the same components as FIG. 1.
Figure 3:
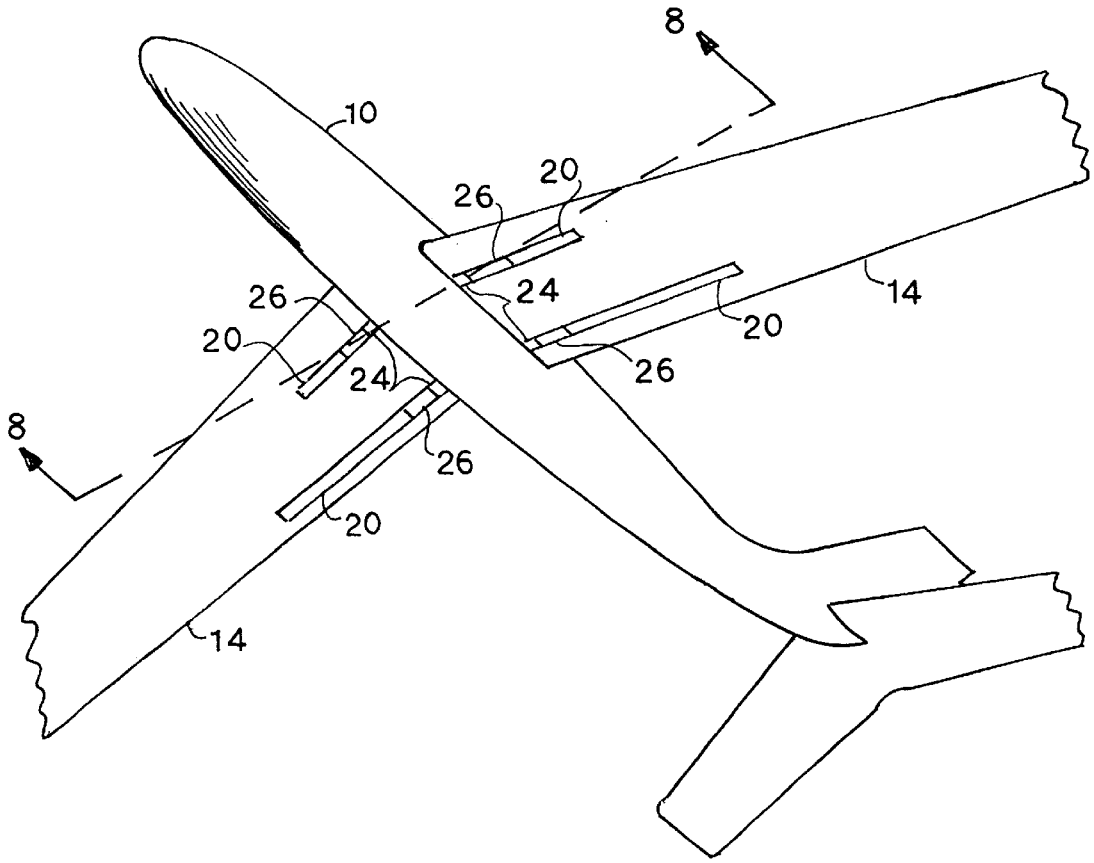
FIG. 3 is a bottom perspective view of the assembled glider.

FIG. 1 and FIG. 2 illustrate top and bottom perspective views, respectively, of a model glider, comprising a fuselage 10 and wings 14, which are shown detached, but would be inserted into a wing slot 12 for flight, as shown in FIG. 3. FIG. 3 is a bottom perspective view of the assembled glider. In the prior art, fuselage 10 and wings 14 might have been held together by tight frictional fit. When the airplane is new, such fit makes it quite difficult to push the wings into their proper positions within the wing slot. After several insertions, however, the foam surface wears away, making the fit loose.

To circumvent this problem, the glider shown in FIGS. 1–3 is equipped with the wing connection system of the present invention. The drawings show the components of the preferred embodiment of the wing connection system, as follows. Wing roots 16 are covered with a low-friction coating 18. Wings 14, and fuselage 10 are equipped with sets of thin non-elastic wing connecting members 20, and fuselage connecting members 24, respectively. Wing connecting members 20 are narrow strips of a high tensile strength non-elastic material and they are installed on the bottom surfaces of wings 14. Fuselage connecting members 24 are installed on the bottom of wing slot 12 so that they extend beyond the sides of fuselage 10. In the preferred embodiment, fuselage connecting members 24 are secured to wing slot 12 through an optional integrated reinforcing member 22. Fuselage connecting members 24 and reinforcing member 22 are manufactured as a single-piece structure of a high tensile strength non-elastic material, identical or similar to the material of wing connecting members 20. When wings 14 are inserted in wing slot 12, each wing connecting member 20 overlaps with one of fuselage connecting members, respectively. To hold wings 14 securely in place during flight, a non-elastic break-away link 26 is used to secure each connection between wing connecting members 20 and fuselage connecting members 24, respectively. In the preferred embodiment, non-elastic break-away links 26 are made from self-adhesive tape. In case of a crash, wing-connecting members 20 and fuselage connecting members 24 channel the impact forces to non-elastic break-away links 26 which snap and wings 14 are released.

A more detailed description of the preferred embodiment follows.

Figure 4:
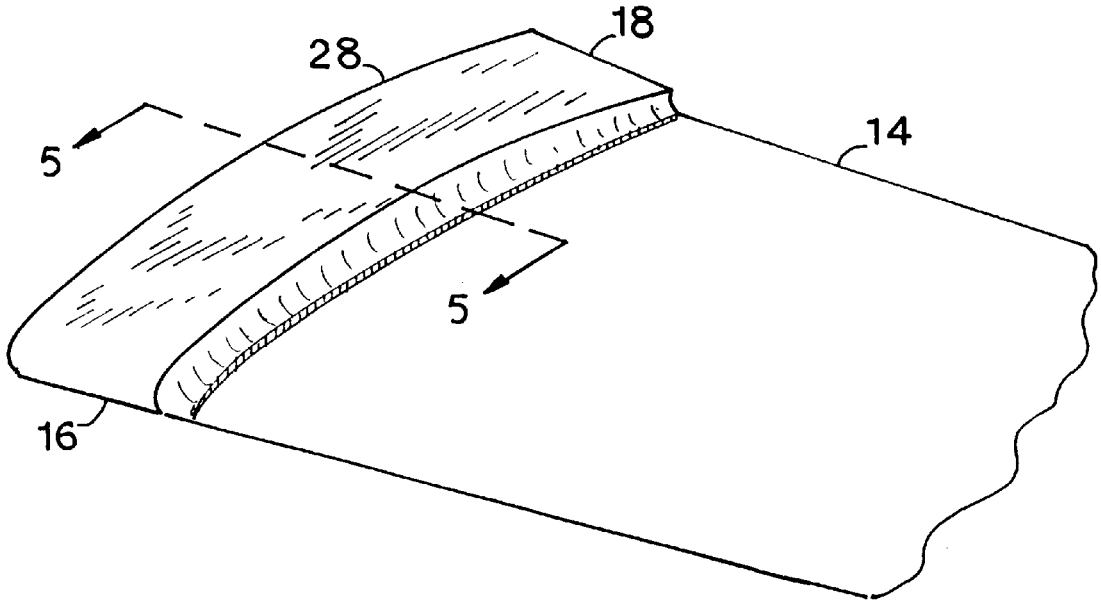
FIG. 4 is a top perspective partial view of the wing, showing the low-friction coating over the wing root.
Figure 5:
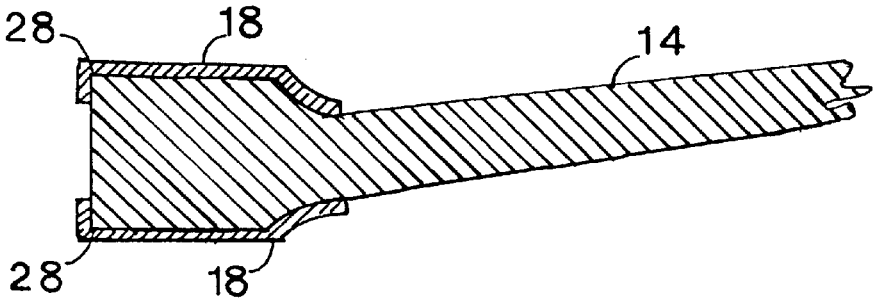
FIG. 5 is a cross-section of the wing along line 5—5 of FIG. 4.

The first important component of the new wing connection system is thin, low friction coating 18, applied over wing roots 16. FIG. 4 and FIG. 5 show the extent of coating 18. FIG. 4 is a perspective view of the root portion of wing 14, while FIG. 5 is a cross-section along line 5—5 of FIG. 4. As clearly shown in the drawings, coating 18 forms a continuous covering around the circumference of wing root 16, extending over its edge 28 to its vertical wall on one end, and to a portion of the wing surface on the other end. The role of coating 18 is threefold: it makes the insertion of the wings easier, assuring more precise positioning; it guarantees that the wings slide out freely from wing slot 12 in case of a crash; and it protects the foam surfaces from premature wear. Because of its extent, it also protects edge 28 which is typically the first portion of wing root 16 to wear away. Thus, the original tight fit is preserved for a much longer time. When coating 18 extends over a portion of the wing surface adjacent to root 16, it also serves as a reinforcement. This can be very useful, since this part of the wing concentrates most of the stress during flight, yet it generally has a smaller cross-section than the wing root.

Coating 18 can be prepared by wrapping a thin layer of a strong, self-adhesive plastic tape, such as commercially available postal mailing tape, around wing roots 16. For aesthetic reasons, clear tape is recommended. For ease of application, the width of the tape should be chosen so, that a single layer can cover the required area. This method is fast and very economical for applying the low friction coating on existing models. Coating 18 can, of course, also be applied to the wing at the time of its manufacturing. It can be added on as a lamination, or the material of the wing can be directly extruded onto it. There is no limitation on the type of material used for the coating, other than it has to produce a low-friction, wear-resistant, and durable surface, and it has to be available for the chosen manufacturing process. Polymer materials, for example polyethylene-terephthalate are recommended.

Coating 18 makes wing roots 16 fit into wing slot 12 tightly, but with little friction. Consequently, the wings might shift out of their proper positions during flight, unless they are secured to the fuselage. The second important component of the proposed wing connection system is the wing securing means which is provided in the form of non-elastic break-away links 26, as opposed to the traditional elastic member. Their relative positioning to wings 14 and fuselage 10 is clearly shown in FIGS. 1, 2, and 3. In the preferred embodiment, two break-away links 26 are used for each wing 14, and they are calibrated so that they withstand the tensile forces encountered in normal flight, but they snap in the event of a crash.

In the preferred embodiment, break-away links 26 are made of invisible plastic self-adhesive tape, whose thickness and width are selected according to the type of the glider. This material is preferred because it is readily available, and inexpensive. It is also very easy to apply and replace after a crash. Other kinds of materials with similar tensile strength can also be used as non-reusable break-away links 26, in such cases they should be secured by external adhesive means.

The break-away links must prevent any lateral movement between the wings and the fuselage during flight. For this, they must be positioned reasonably parallel with each other and perpendicular to the long axis of the fuselage. To provide means for attaching break-away links 26 to the fuselage in their proper alignments, four non-elastic parallel fuselage connecting members 24 are secured to the bottom surface of wing slot 12 so that they are extruding perpendicular to the fuselage. Fuselage connecting members 24 direct the impact forces of a crash to break-away links 26. Fuselage connecting members 24 could be attached to the bottom of wing slot 12 as two parallel strips, in case of a continuous wing slot or as four shorter strips, in case of two separate wing slots. However, to reduce the stress on wing slot 12 and to make the installation of fuselage connecting members 24 easier, the connecting members are integrated with reinforcing member 22, which strengthens fuselage 10.

Reinforcing member 22 should be very thin as not to hinder the insertion of wing 14 into wing slot 12. Fuselage connecting members 24 can be manufactured as an integrated piece with reinforcing member 22. This integrated unit can be cut out of a thin sheet material with a great tensile strength. One example is an approximately 0.2 mm (0.01 inch) thick Mylar sheet. Alternatively, it can be molded, extruded, etc.

To serve as attachment means for break-away links 26 on wings 14, and to direct the impact forces of a crash onto the break-away links, four non-elastic wing connecting members 20 ire installed on the wings so that they are aligned with corresponding four fuselage connecting members 24 when the glider is properly assembled. Their positioning can also be seen in FIGS. 1, and 2. In particular, each wing 14 has two parallel wing connecting members 20 cemented lengthwise onto its bottom surface, so that they are approximately perpendicular to fuselage 10. (Theoretically, the break-away links could be secured directly to the bottom surfaces of the wings, but this is not recommended. The semi-rigid wings of a foam plane would not focus the impact forces of a crash effectively on the break-away links. Furthermore, the repeated removal of an adhesive tape could damage the wing surfaces.)

Wing connecting members 20 are thin, but strong, preferably cut out of a sheet of material that is light-weight and non-elastic, with a good tensile strength, such as approximately 0.25–0.8 mm (0.01–0.03 inch) thick Mylar, polycarbonate or other suitable substance. They could also be manufactured by molding, extruding, etc. They should preferably cover about one third of the length of wing 14 to provide enough support and to reinforce the wings, without adding too much weight. Wing connecting members 20 extend almost up to wing root 16, so that they are near fuselage 10 in the assembled glider without actually touching it.

Wing connecting members 20 and fuselage reinforcing member 22 are secured permanently to their respective positions, preferably by adhesive bonding.

Figure 6:
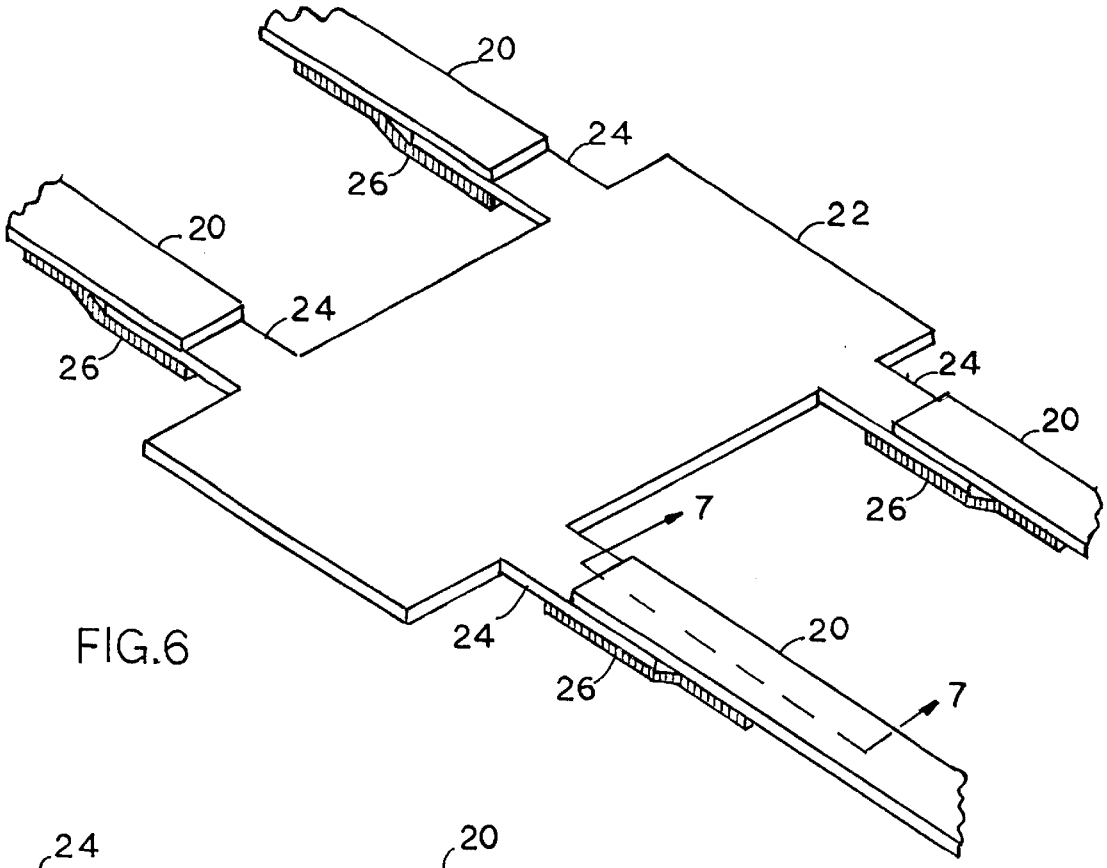
FIG. 6 illustrates, in an schematic perspective view, the connecting elements of the wing connection system.

FIG. 6 shows a perspective view of the elements of the wing connection system. When the glider is assembled, wing connecting members 20 overlap with fuselage connecting members 24, and they are connected by break-away links 26. Since all the elements shown in the drawing are made of non-elastic material, the wing connection system holds the wings securely in their proper positions, even in a strong wind.

Figure 7A:
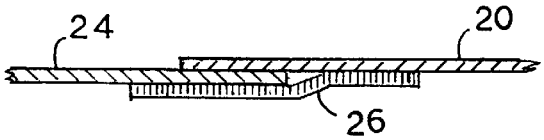
FIG. 7A is a cross-section along line 7—7 of FIG. 6, showing an intact break-away link.
Figure 7B:
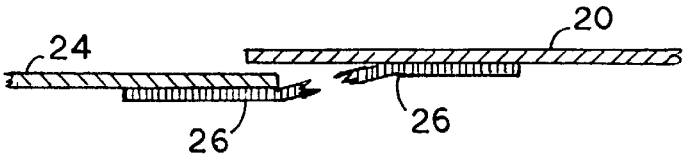
FIG. 7B is the same as FIG. 7A, but showing a broken break-away link, after a crash.

FIG. 7A and FIG. 7B show a cross-section of the connecting elements along line 7—7 of FIG. 6. FIG. 7A exhibits an intact break-away link 26, while FIG. 7B illustrates how break-away link 26 snaps in case of a crash, allowing wing connecting members 20 and fuselage connecting members 24 to separate, releasing the wing. In the most common type of crash, the fuselage's nose hits a hard surface and the wings' inertia forces make the wings rotate forward snapping the rear break-away links. In a crash were a wing tip hits a hard surface, the wing's inertia forces make the wing rotate backward, snapping the front break-away link on that wing. In both cases, the wings slide out of the wing slots easily, absorbing most of the impact forces.

FIG. 8 is a cross-section of the glider's body along line 8—8 of FIG. 3. FIG. 8 shows the correct positions of wings 14 relative to fuselage 10 during a typical flight. For clarity, a gap is shown between the left and right wings in the figure. In reality, the wings of this type of glider are generally touching each other in the middle of the continuous wing slot when fully inserted. Because of the presence of low friction coating 18, wings 14 are easily inserted into the wing slot, where they are kept in their correct positions vertically by a tight fit, and held firmly in place laterally by non-elastic break-away links 26.

Accordingly, the reader can see that the impact absorbing wing connection system of this invention holds the wings very tightly in place during flight, avoiding any relative movement between the wings and the fuselage, since there are no elastic links or rubber bands used in the connection. In case of a crash, most of the impact energy is absorbed by the break-away link and the detaching wings, protecting the aircraft. After the crash, the wings are effortlessly re-inserted into the fuselage, and the inexpensive brake-away links are easily replaced. Another advantage of the present wing connection system is that no holes or recesses, which would weaken the structure, are needed to be formed in the wings or fuselage of an existing aircraft. Furthermore, the wing connecting members and the reinforcing member of the fuselage strengthen the glider in places where the greatest amount of stress is present. Since the wing connecting members are cemented practically flush with the wing's surface, they detract neither from the aesthetic look of the glider nor from its aerodynamic properties. A foam airplane, outfitted with the present wing connection system, can be enjoyed for a much longer time than a similar airplane with a traditional wing assembly.

While the above description contains many specificities, these should not be construed as limitations on the scope of the invention, but rather as an exemplification of one preferred embodiment thereof. Many other variations are possible.

For example, the break-away link of the wing connection system can have other embodiments, in which it is re-usable. One particular alternative embodiment of the break-away link is based on a snap closure as shown in FIGS. 9A to 9C. FIGS. 9A, and 9B show perspective views of the connected, and disconnected alternative break-away link, respectively. FIG. 9C is a cross section of the alternative break-away link along line 9C—9C of FIG. 9A. In this embodiment, each wing connecting member 20 has a built-in break-away receptacle 30, while each fuselage connecting member 24 has a built-in break-away clasp 32. When break-away receptacle 30 is manufactured with the appropriate angle S, shown in FIG. 9C, it holds break-away clasp 32 firmly in place under reasonable flying conditions. However, when a large tension force is applied on the connection, as in the case of a crash, break-away clasp 32 snaps free. The components of the alternative break-away link can be made of the same non-elastic material as the connecting members (i.e. polycarbonate). The thickness of the components has to be designed so that they are semi-rigid, meaning that they do not allow any horizontal movement between the wings and the fuselage when properly engaged, but they are able to disengage upon a crash impact. The main advantage of this design over the preferred embodiment is that the alternative break-away link is re-usable. The main disadvantage is that it is more expensive to manufacture, since break-away receptacle 30 and break-away clasp 32 have to be molded, while all the components of the preferred embodiment of the wing connection system can simply be cut out of sheet material. Further modifications to the design and material of the break-away link are possible.

There are also several alternative ways for reducing the friction between the wings and the fuselage. One way is to apply a low-friction coating to the inside of the wing slot, instead of the wing roots. Another way is to coat both the inside of the wing slot, and the wing roots. The low-friction coating can also be extended to other parts of the wings and the fuselage, where it can serve both protective and decorative purposes. The low friction coating can be eliminated altogether, if the material itself of the aircraft presents other means for reducing the friction. Reinforcing member 22, when provided, can also serve as friction-reducing means. When a second reinforcing member is installed on the top surface of the wing slot, it keeps the wings from directly touching the high-friction surface of the wing slot, so they can slide in and out easily.

Reinforcing member 22 of the preferred embodiment can also be omitted. Its main purpose in the preferred embodiment is to distribute the stress of the connection more evenly over the wing slot and to keep the fuselage connecting members properly aligned with the wing connecting members. On aircraft with separate wing slots for the left, and right wings, separate fuselage reinforcing elements can be installed to fit the wing slots. When the fuselage reinforcing element is omitted, the fuselage connecting members can be directly and permanently attached to the fuselage of the aircraft.

The design of the fuselage connecting members can be changed to be appropriate for the type of break-away links used. The strip design of the preferred embodiment is practical when adhesive tapes are used as break-away links. The main purpose of the fuselage connecting members is to serve as attachment means for the break-away links and to channel the impact forces onto them. In accordance, the shape of the connecting members can vary, as long as they practically serve this purpose.

Long wing connecting members are important on aircraft made of semi-rigid, breakable plastic foam material. On such aircraft, besides conveying the impact forces of a crash to the break-away links, the wing connecting members also reinforce and strengthen the wings and protect them from breaking. However, on aircraft made of stronger, rigid material, the rigid wing material itself conveys the impact forces to the junction of the wings and the fuselage. In this case, the wing connecting members can be made smaller, as their main purpose now is to provide attachment means for the break-away links. In accordance, their shape can vary, as long as they practically serve this purpose.

To secure the wings properly to the fuselage, at least two break-away links are needed on each wing, as demonstrated in the preferred embodiment. However, more than two break-away links might be used, as long as their cumulative strength is such that they release the wings in case of a crash. For example, two weak break-away links can be used on the forward portion of each wing, and two other weak break-away links can be used on the backward portion of each wing. Naturally, the number of connecting members on the wings and fuselage has to match the number of break-away links.

Even though the impact-absorbing wing-connection system has been demonstrated on a model glider, it can also be used on other flying toys, not shaped as an airplane, such as birds, fictional characters, etc., as long as these toys have a body comparable to the fuselage of an aircraft, and separate wings that can be inserted into wing slots in the body.

Accordingly, the scope of the invention should be determined not by the examples given, but by the appended claims and their legal equivalents.

What is claimed is:

1. An impact absorbing wing connection system for a model airplane or other flying toy of the type having a fuselage and separate wings which are inserted into wing slots in said fuselage for flight, comprising:

(a) friction reducing means between said wings and said wing slots to facilitate the attaching and detaching of said wings, (b) a plurality of non-elastic break-away links to hold said wings securely in said wing slots during normal flight; and (c) an equal plurality of non-elastic connecting members on said wings and said fuselage, respectively, to provide attachment means for said break-away links;

whereby said wings of said aircraft or flying toy stay in their proper positions during normal flight, resulting in an enhanced flight performance; and whereby, in case of a crash, said connecting members direct the impact forces onto said break-away links, said break-away links break open and said wings slide out of said wing slots without significant resistance, absorbing most of said impact forces and protecting said airplane or flying toy.

2. The wing connection system of claim 1, wherein said break-away links are provided in the form of adhesive tape.

3. The wing connection system of claim 1, wherein said break-away links are provided in the form of a snap closure.

4. The wing connection system of claim 1, wherein said break-away links are integrated with said connecting members.

5. The wing connection system of claim 1, wherein said connecting members on said wings are thin and narrow strips of non-elastic material.

6. The wing connection system of claim 1, wherein said connecting members on said fuselage arc thin and narrow strips of non-elastic material.

7. The wing connection system of claim 1, wherein said connecting members on said fuselage are attached to a reinforcing member installed inside said wing slot.

8. The wing connection system of claim 1, wherein said friction reducing means comprises a low friction coating over the roots of said wings.

9. The wing connection system of claim 8, wherein said low friction coating extends over other parts of said wings.

10. The wing connection system of claim 1, wherein said friction reducing means comprises a low friction coating inside said wing slots.

11. The wing connection system of claim 10, wherein said low friction coating extends over other parts of said fuselage.

12. The wing connection system of claim 1, wherein said friction reducing means is a manufacturing process.

13. The wing connection system of claim 1, wherein said connecting members are made of a polymer plastic material.

14. The wing connection system of claim 1, wherein said flying toy is shaped as a natural or fictional character, and said fuselage comprises the body of said natural or fictional character.

15. On a model airplane or other flying toy of the type having a fuselage and separate wings which are to be inserted into wing slots in said fuselage for flight, an impact absorbing method of connecting said wings to said fuselage, comprising:

(a) providing friction reducing means between said wings and said wing slots which will facilitate the attaching and detaching of said wings;

(b) providing a set of non-elastic fuselage connecting members on said fuselage;

(c) providing a corresponding set of non-elastic wing connecting members on said wings which will be aligned with said fuselage connecting members when said wings are inserted into said wing slots;

(d) inserting said wings into said wing slots; and (e) securing said wings to said fuselage by a set of non-elastic break-away links which are attached to said fuselage and said wings through said fuselage connecting members and said wing connecting members, respectively;

wherein said break-away links are calibrated to withstand the forces acted upon them under reasonable flying conditions;

whereby said wings of said aircraft or flying toy will stay in their proper positions during normal flight, resulting in an enhanced flight performance; and whereby, in case of a crash, said wing connecting members and said fuselage connecting members will direct the impact forces onto said break-away links, said break-away links will break open and said wings will slide out of said wing slots without significant resistance, absorbing most of said impact forces and protecting said airplane or flying toy.

16. The wing connection method of claim 15, wherein said break-away links are provided in the form of adhesive tape.

17. The wing connection method of claim 15, wherein said break-away links are provided in the form of a snap closure.

18. The wing connection method of claim 15, wherein said wing connecting members and said fuselage connecting members are presented as thin and narrow strips of non-elastic polymer plastic material.

19. The wing connection method of claim 15, wherein said friction reducing means comprises a low friction coating over the inserted portions of said wings.

20. The wing connection method of claim 15, wherein said friction reducing means comprises a low friction coating inside said wing slots.

* * * * *